US005670766A

United States Patent [19]

Ellett

[11] Patent Number: 5,670,766

[45] Date of Patent: Sep. 23, 1997

[54] PRESSURE SWITCH

[75] Inventor: James Richard Ellett, Edmonton, Canada

[73] Assignee: Argus Machine Co. Ltd., Edmonton, Canada

[21] Appl. No.: 531,775

[22] Filed: Sep. 21, 1995

[51] Int. Cl.[6] ..... H01H 35/38

[52] U.S. Cl. ..... 200/83 J

[58] Field of Search ..... 200/81 R, 82 R, 200/82 C, 82 A, 83 R, 83 WM, 83 B, 83 J, 83 P, 835, 835 A, 83 V, 834, 83 W

[56] References Cited

U.S. PATENT DOCUMENTS

| | | | |
|---|---|---|---|
| 2,748,218 | 5/1956 | Leichsenring | 200/83 |
| 2,767,276 | 10/1956 | Buchanan et al. | 200/82 |
| 3,407,277 | 10/1968 | Chapin | 200/83 |
| 3,449,535 | 6/1969 | Otto et al. | 200/82 |
| 3,619,526 | 11/1971 | Riley | 200/83 J |
| 3,679,325 | 7/1972 | Yost | 417/17 |
| 4,503,301 | 3/1985 | Kurtz | 200/83 |
| 4,593,166 | 6/1986 | Hirota et al. | 200/835 |
| 4,900,883 | 2/1990 | Brame et al. | 200/83 |
| 5,122,628 | 6/1992 | McLelland et al. | 200/83 |
| 5,243,158 | 9/1993 | Zimmermann | 200/83 |
| 5,554,834 | 9/1996 | Ellett | 200/82 A |

OTHER PUBLICATIONS

Camrose Electric Controls Ltd., Edmonton, Alberta, Canada, Parts RS73 Pressure Controls, 1 page, 1993.

Barber Industries Ltd., Edmonton, Alberta, Canada, Instructions for Installing and Operating High–Temp Presco–Switches, Type DHTE, Jan. 1992, 1 page.

*Primary Examiner*—Michael L. Gellner
*Assistant Examiner*—Michael A. Friedhofer
*Attorney, Agent, or Firm*—Anthony R. Lambert

[57] ABSTRACT

A pressure actuated switch has a diaphragm mounted across a piston having a piston head. Movement of the piston under pressure variations acting on the diaphragm actuates the pressure switch. A support disc is provided for the diaphragm, the support disc being mounted between the diaphragm and the piston. The support disc is preferably made of a high tensile elastic material and has an outer annulus that extends beyond the piston head, an inner disc that is smaller in diameter than the piston head; and a flexible intermediate annulus cantilevered between the outer annulus and the inner disc.

16 Claims, 8 Drawing Sheets

PRESSURE SWITCH

FIELD OF THE INVENTION

This invention relates to pressure switches.

BACKGROUND AND SUMMARY OF THE INVENTION

In the design of pressure switches, a rod slidable within a housing and movable by changes in external fluid pressure operates a plunger of a mechanically operated switch, which may be an electrical, pneumatic or hydraulic switch. Resistance of the rod to movement, and hence the pressure at which the switch trips, is adjusted by a spring within the pressure switch that is biased against movement of the rod due to external fluid pressure. Adjustment of the compression on the spring changes the tripping pressure. Pressure in the environment acts directly upon a diaphragm that bears against a piston on an end of the rod distant from the switch.

In two prior art pressure switches, model no. RS73 of Camrose Electric Controls Ltd. of Edmonton, Alberta, Canada, and model DHTE of Barber Industries Ltd. of Edmonton, Alberta, Canada, a metal diaphragm is used and in a switch described in U.S. Pat. No. 3,619,526, a nitrile or butyl rubber diaphragm is used. The diaphragm is secured across the end of the piston, with an inner part of the diaphragm supported by the piston and an outer annulus of the diaphragm supported by a gasket, spacer ring or the piston guide in which the piston sits. In each case, pressure variations cause the center of the diaphragm to move in and out, causing bending of the diaphragm between its central disc and the outer annulus, with the result that the diaphragm tends to work harden and fail at the bending points.

The invention described and claimed here is intended to overcome the limitations of the known prior art. In one aspect of the invention, there is provided a pressure switch comprising a housing, a piston guide mounted within the housing, the piston guide having an interior bore and a first end, the interior bore forming an opening at the first end, a diaphragm mounted on the piston guide across the opening, a piston slidable over a limited range within the interior bore under external fluid pressure acting on the diaphragm, the piston having a piston head, a mechanically operated switch operatively connected to the piston; and a support disc for the diaphragm, the support disc being mounted between the diaphragm and the piston.

In a further aspect of the invention, the support disc is preferably made of a high tensile elastic material and includes an outer annulus that extends beyond the opening, an inner disc that is smaller in diameter than the piston head; and a flexible intermediate annulus cantilevered between the outer annulus and the inner disc.

In a further aspect of the invention, the piston guide preferably has a conical annular depression centered on the opening and the flexible intermediate annulus substantially covers the conical annular depression.

In a further aspect of the invention, the limited range over which the piston is slidable is preferably centered such that at maximum operating pressure the diaphragm flexes about the same amount as the diaphragm flexes at minimum pressure but in the opposite direction.

In a further aspect of the invention, the flexible intermediate annulus is cantilevered on the inner disc and outer annulus by inner and outer sets of circumferentially extending torsion bars.

In a further aspect of the invention, the torsion bars of the inner set of torsion bars extend outward no further than the diameter of the piston head.

In a further aspect of the invention, the inner and outer sets of torsion bars are bounded and defined by inner and outer sets respectively of spiral slots.

In a further aspect of the invention, the flexible intermediate annulus is divided into segments by radially extending slots joining corresponding spiral slots of the inner and outer sets of spiral slots.

In a further aspect of the invention, spiral slots of the inner set of spiral slots may terminate in inwardly curved portions, and spiral slots of the outer set of spiral slots may terminate in outwardly curved portions.

In a further aspect of the invention, torsion bars of the outer set of torsion bars are located at the outer boundary of the conical depression.

In a further aspect of the invention, a pressure switch has a housing with an interior bore, a rod slidable over a limited range within the bore under external fluid pressure, a mechanically operated electrical switch operatively connected to the rod, adjustment means encapsulated within the housing including a spring opposed to movement of the rod under external fluid pressure, a sleeve engaging the spring, and the sleeve being threaded into the bore of the housing for movement longitudinally within the housing to adjust compression on the spring, a port in the housing for access to the adjustment means; and a lock to secure the adjustment means against longitudinal movement.

In a further aspect of the invention, the sleeve includes plural slots and the lock includes a block with pins extending radially inward for mating with one of the plural slots.

In a further aspect of the invention, the switch includes a removable cover for the port in which the cover includes a ring disposed around the housing and threaded onto the housing over the port, the block being made of resilient material and extending radially outward sufficient to be compressed by the ring against the sleeve during use.

These and other aspects of the invention are described in the detailed description and claims that follow.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1A:
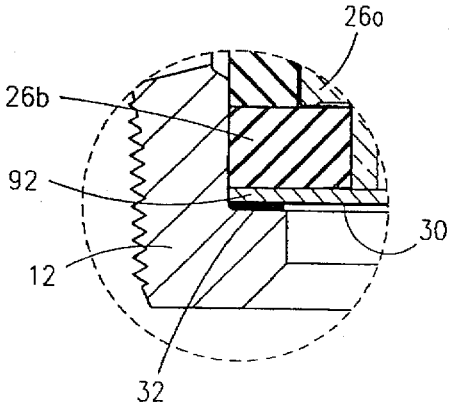
FIG. 1A is a detail of a gasket for use in the pressure switch of FIG. 1.
Figure 1:
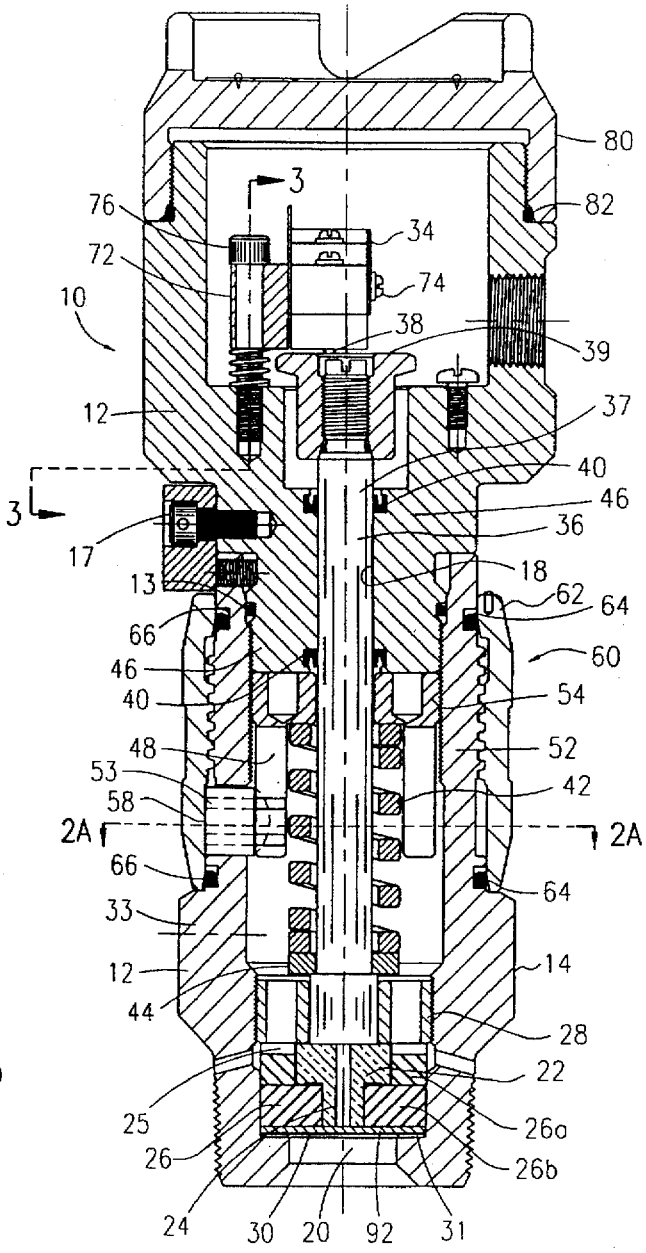
FIG. 1 is a longitudinal section through a pressure switch according to the invention.
Figure 2A:
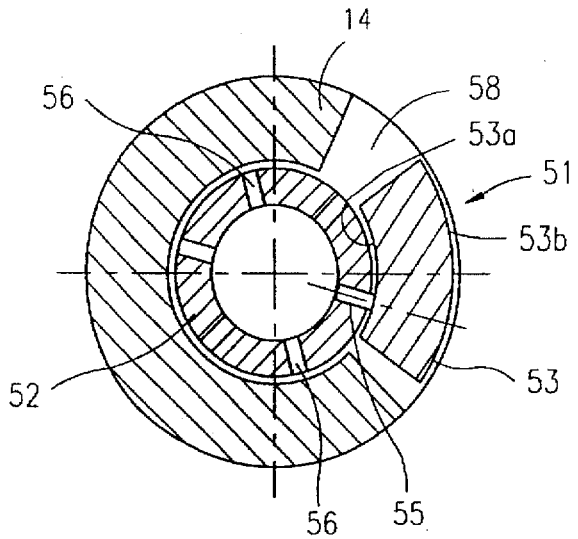
FIG. 2A is a cross-section through an adjustment sleeve for a pressure switch according to the invention showing an anti-vibration adjustment lock.
Figure 2B:
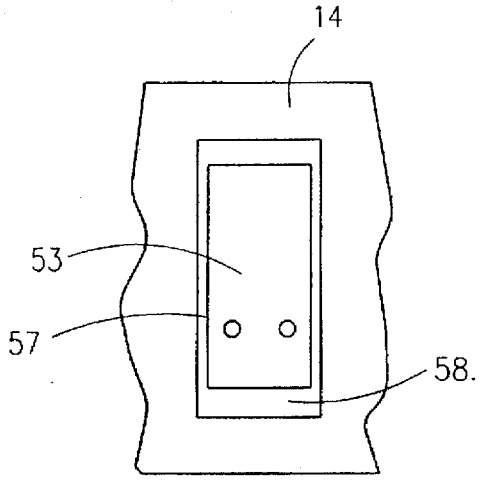
FIG. 2B is a side view of the anti-vibration adjustment lock of FIG. 2A.
Figure 2C:
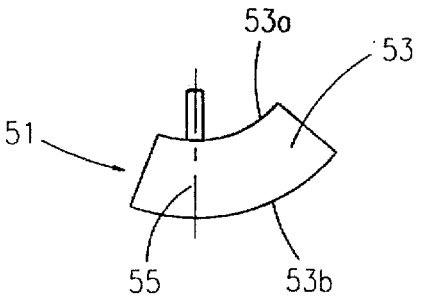
FIG. 2C is a side view, partially in section, showing a part of the locking mechanism of FIG. 2A.
Figure 2D:
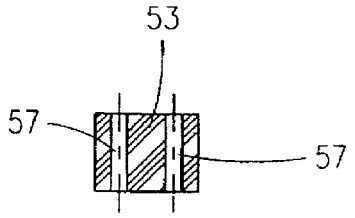
FIG. 2D is a section through the part of FIG. 2C.

Referring to FIGS. 1 and 2A, there is shown a pressure switch 10 that may be used with the support disc of the invention. The pressure switch 10 is formed of a housing 12 having a first end 14 and a second end 16 threaded together and sealed with seals 13. Set screw 17 locks the first end 14 and second end 16 of the housing together. A bore 18 of variable inner diameter passes through the housing 12 from the first end 14 to the second end 16. In the bore 18 at the first end 14 is a piston 22 that is free to move longitudinally a limited amount within the bore 18. The piston 22 is shown here as including a piston head 24 snugly fitted in piston guide 26 at the first end 14 of the housing 12. The piston guide 26 is formed in two pieces (upper 26*a* and lower 26*b*) and is secured within the housing by a locking nut 28 threaded in the first end of the housing 12. Four laterally extending slots 25 in the top end of upper piece 26*a* of the piston guide 26 allow for draining of fluid. Two of the slots 25 are shown. The other two are at right angles to the section of FIG. 1. End 20 of the bore 18 is sealed by diaphragm 30 that is held firmly within the end 14 by the piston guide 26 and housing 12 and sealed with a gasket 32 or a suitable alternative such as a seal ring. A support disc 92, described in more detail in relation to FIGS. 8, 9, 10 and 11 below, is interposed between the diaphragm 30 and piston 22 and assists in supporting the diaphragm 30 against collapse from external fluid pressure. Range of movement of the piston is limited by shoulders 35*a* and 37*a* on the piston guide 26 and by shoulders 35*b* and 37*b* on the piston 22.

A mechanically operated electrical switch 34 (microswitch) is disposed at the second end 16 of the housing 12. A rod 36 is mounted slidably within the housing 12 and extends between the piston 22 and the mechanically operated electrical switch 34. By direct contact with the piston 22 and plunger 38 of the switch 34, the rod 36 is operatively connected to both the piston 22 and the switch 34, but this operative connection may be accomplished using intervening devices, with added complexity. The diaphragm 30, piston 22 and rod 36 function as a mechanism to transfer external fluid pressure along rod 36 to the mechanically operated electrical switch 34. The mechanically operated electrical switch (common in the art in itself) is operated by a plunger 38, which abuts against hub 39 threaded onto the end 37 of rod 36. Movement of the rod 36 and hub 39 in the direction from the first end of the housing 12 to the second end depresses the plunger 38 and activates the switch 34. The end 37 of the rod 36 is sealed within the bore 18 by elastomer seals 40.

A spring 42 is disposed about the rod 36 between a first stop 44 on the rod 36 and a second stop 46 forming part of the housing 12. The spring 42 provides resistance against movement of the rod 36 from the first end 14 of the housing 12 to the second end 16 of the housing 12. The spring 42 is preferably a compression spring, but may conceivably be in tension. The degree of resistance of the spring 42 to external fluid pressure on piston 22, hence movement of rod 36, is adjustable by adjustment means 48 encapsulated within the housing 12.

The adjustment means 48 includes a sleeve 52 surrounding and thus engaging one end of the spring 42. The sleeve 52 includes a threaded portion 54 threaded into the bore 18 of the housing 12 for movement longitudinally within the housing 12 by rotation of the sleeve 52. Referring in particular to FIG. 2A, plural radially extending slots 56 are disposed around the sleeve 52. The slots 56 may be of various shapes, but should be shaped to receive an implement, such as a screw driver, used to rotate the sleeve 52. A port 58 or opening in the housing 12 is provided and makes the adjustment means 48 accessible, for example by a screwdriver or other means for operating the adjustment means 48. A cover 60 for the port 58 is provided by a ring 62 disposed around the housing 12 and threaded onto the housing 12 over the port 58. The opposed ends of ring 62 are sealed against the housing 12 when the cover is in the closed position by O-ring seals 64 placed in grooves 66 formed in the housing 12. By unthreading the ring 62 towards the second end 16 of the housing 12, the port 58 is uncovered, allowing access to the adjustment means 48. Tightening of the cover 60 against the seals 64 ensures isolation of the adjustment means from the external environment.

Referring to FIGS. 2A, 2B, 2C and 2D, there is also provided an anti-vibration adjustment lock 51 for the pressure switch. The lock 51 resists rotational movement of the sleeve 52 within the first end 14 of the housing 12 that may occur due to vibration of the pressure switch in use. The lock 51 is formed by an arcuate resilient graphite or glass filled Teflon™ block 53 having a pair of split pins 55 inserted into slots 57 and extending inward from inner face 53*a* of the block. The inner face 53*a* of the arcuate block 53 has a smaller radius of curvature than the outer face of sleeve 52. The outer face 53*b* of arcuate block 53 extends sufficiently radially outward that positioning of the ring 62 over the block 53 compresses the block 53 inward against the sleeve 52. The arcuate block 53 preferably extends about 60° to 70° of arc, and the split pins 55 are preferably offset from the center of this arc, for example by about 15° so that the block 53 can be oriented in different setting positions in relation to a slot 56. The blocks 53 may be made by cutting segments out of a Teflon™ ring. Compression of block 53 against sleeve 52 helps prevents the arcuate block 53 from vibrating during use. The pins 55 prevent rotation of the sleeve 52 thereby locking the sleeve 52.

At the second end 16 of the housing 12, the bore 18 is enlarged to receive the electrical switch 34. A switch mounting block 72 secures the electrical switch 34 in a fixed position. This fixed position of the electrical switch must be set carefully upon manufacture of the pressure switch so that travel of the rod 36 within its limited range of motion is sufficient to trip the plunger 38 of the electrical switch 34. The precise setting of the position of the mechanically operated electrical switch that is permitted by this design of the mounting block avoids the need for precise tolerances during manufacturing, which would be impractical to achieve.

Figure 3:
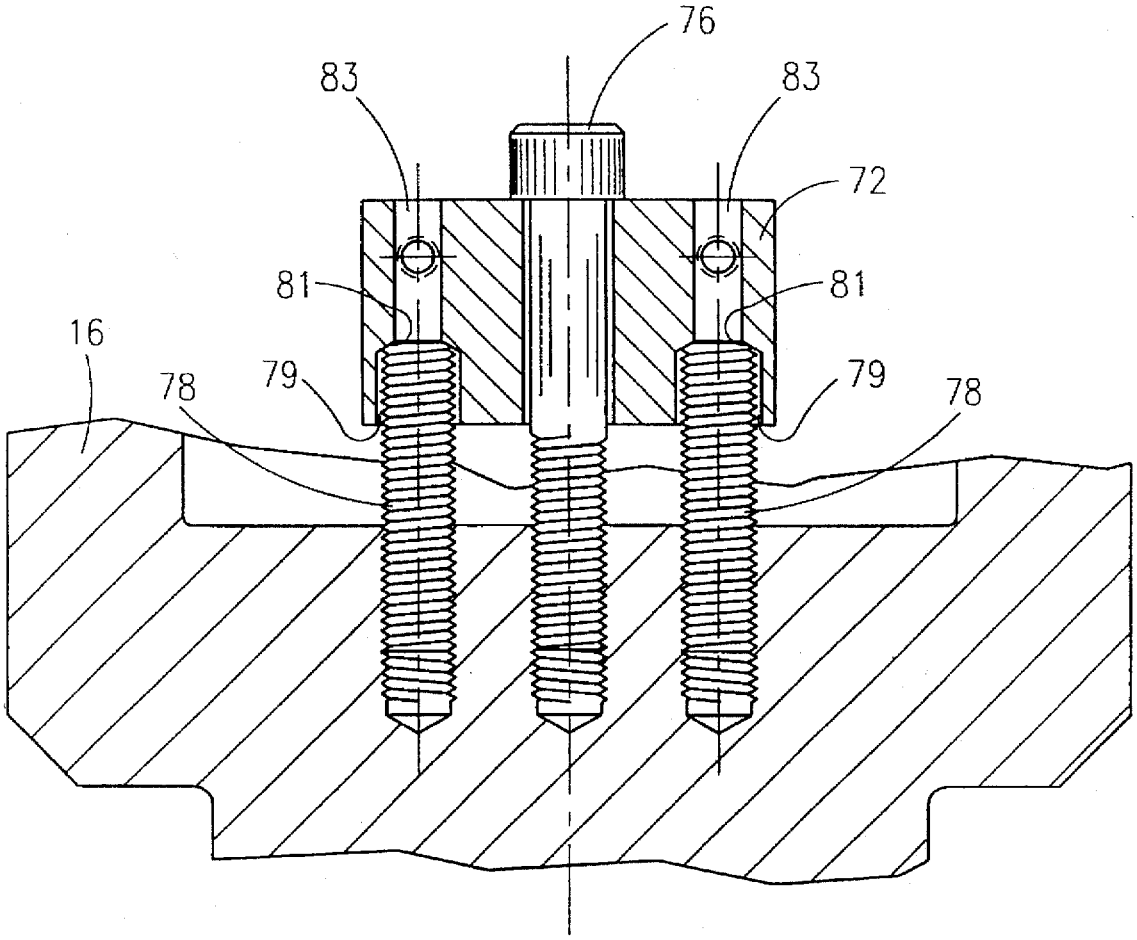
FIG. 3 is a cross-section through a switch mounting block for use with the pressure switch of FIG. 1.
Figure 4:
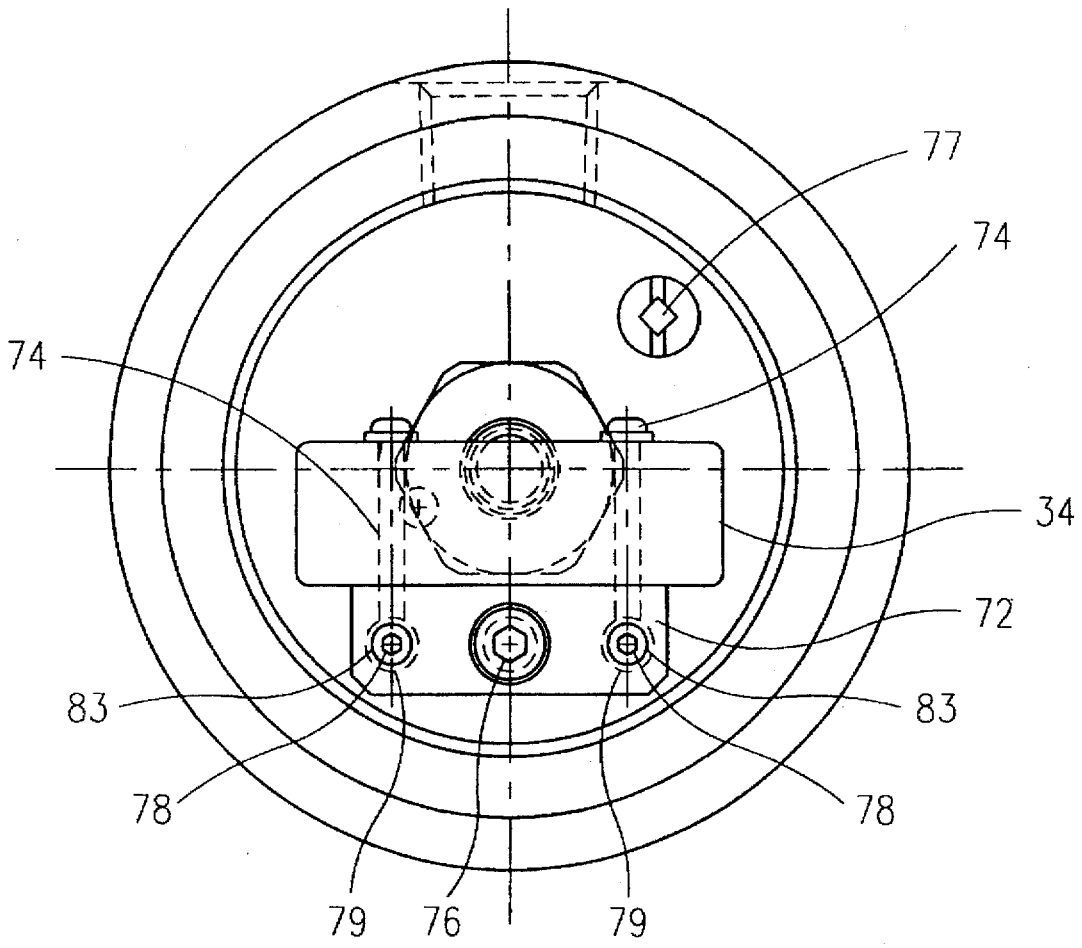
FIG. 4 is a top end view of the pressure switch of FIG. 1.

Referring in particular to FIGS. 3 and 4, the switch mounting block 72 includes a pair of transverse mounting screws 74 to secure the mechanically operated electrical switch 34 on the switch mounting block 72. A ground screw 77 is provided within the enlarged end 16 of the housing to provide a termination point for a grounding wire.

A central hold down screw 76 passes through the switch mounting block 72 and is threaded longitudinally into the second end 16 of the housing 12 towards the first end of the housing 14. A pair of jacking screws 78 flank the central screw 76 and are screwed into the second end of the housing 12. Each of the jacking screws 78 is received in a screw receiving counterbore 79 in the switch mounting block 72 whose shoulders 81 provide limit points for movement of the switch mounting block about the central hold down screw 76. Each of the screws 76, 78 is accessible for rotation from the second end 16 of the housing 12. Reduced diameter portions 83 of the bores 79 extend through the switch mounting block 72 thereby provided access to the jacking screws 78. The jacking screws 78 support the switch mounting block and relative adjustment of the jacking screws to each other permits accurate alignment of the switch mounting block. The height of the jacking screws 78 above the switch mounting block 72 establishes the tripping point of the mechanically operated electrical switch 34. The hold down screw 76 is not threaded into the switch mounting block and thus holds down and fixes the switch mounting block in relation to the jacking screws and therefore the housing. An end cap 80 threads onto the second end 16 of the housing 12 with O-ring seal 82 to enclose and secure within it the mechanically operated electrical switch 34.

Figure 5:
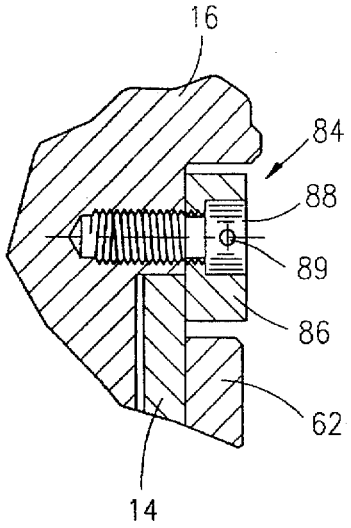
FIG. 5 is a side section through an adjustment access sealing assembly for use with the pressure switch of FIG. 1.
Figure 6:
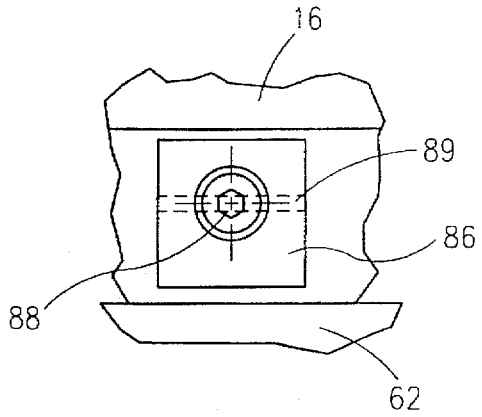
FIG. 6 is a side view of the adjustment access sealing assembly of FIG. 5.
Figure 7:
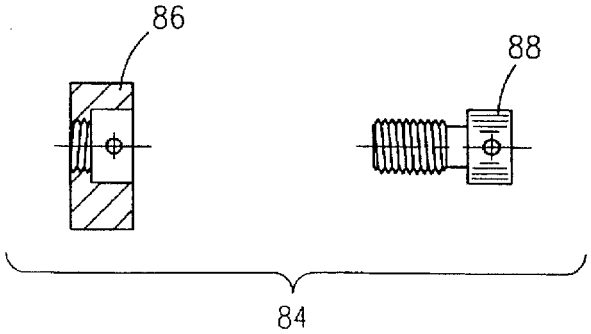
FIG. 7 is an exploded view of a holding block and screw for use with the adjustment access sealing assembly of FIG. 5.

Referring to FIGS. 5, 6 and 7, there is shown an adjustment access sealing assembly 84 that may be used as a stop to prevent the adjustment cover ring 62 from moving axially along the pressure switch. The assembly 84 is formed from a holding block 86 and holding screw 88. The holding block 86 is secured to the housing 16 by threading of the holding screw 88 through the holding block 86 into the housing 16 adjacent the cover ring 62. A sealing wire or cable (not shown) forming a seal can be inserted in cross bore 89 to prevent unauthorized removal of the holding screw 88 and the holding block 86. Any intrusion into the pressure switch will then be made apparent from the breaking of the seal.

Adjustment of the tripping pressure is as follows. The cover 60 is unthreaded, revealing the port 58. A screwdriver or like instrument is used to rotate the sleeve 52 and move it up or down in accordance with the direction of rotation, thus altering the compression of the spring. The pressure setting can be calibrated if desired with marks on the sleeve 52 or on the sides of the port 58 or on both the sleeve and the sides of the port 58. The rotational and hence axial location of the sleeve 52 may be secured by insertion of the anti-vibration adjustment lock 51 into one of the slots 56 with block 53 compressed against the sleeve 52 and the pins 55 inserted into one of the slots 56. After adjustment of the sleeve 52, the cover may be threaded down over the port 58, thus securing the adjustment means against tampering. To further secure the adjustment means, the sealing assembly 84 may be threaded into the housing 16 to prevent axial movement of the cover ring 62 thus limiting movement of the cover away from the port and ensuring complete enclosure and sealing of the adjustment means 60.

Referring to FIGS. 8–11, there is shown a piston guide 26, support disc 92 and diaphragm 30 configuration according to the invention. The piston guide 26 is mounted in the housing 12 as shown in FIG. 1. The piston guide 26 has an interior bore and a first end 94 with the interior bore forming an opening at the first end 94. Diaphragm 30 is mounted on the piston guide 26 across the opening. As shown in FIG. 1, but not shown in FIGS. 8 and 11, the diaphragm 30 is contained within the housing 12 by shoulder 31. A piston 24, with shoulders **35*b* and 37*b*, is mounted within the piston guide 26 and is slidable over a limited range between stops 35*a* and 35*b* under external fluid pressure acting on the diaphragm 30. The limited range over which the piston 24 is slidable is centered such that at maximum operating pressure (FIG. 11) the diaphragm flexes about the same amount as the diaphragm flexes at minimum pressure (FIG. 8) but in the opposite direction. Thus, the flat end face 99 of the piston head 26 is at the mid point of travel of the piston 24. A support disc 92 is mounted between the diaphragm 30 and the piston 24 to support the diaphragm 30 and relieve the diaphragm 30 from bending and unsupported stresses. The support disc 92** is preferably made from a high tensile elastic material such as 718 Inconel™ stainless steel, or other high tensile steel that is resistant to corrosion in a sour gas environment.

Figure 10:
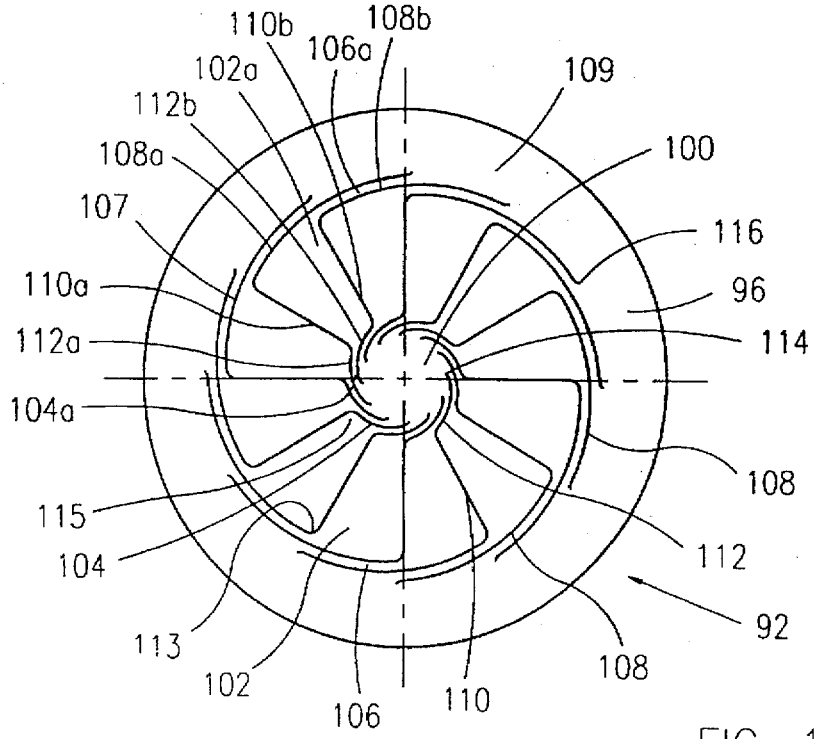
FIG. 10 is a top view of a support disc according to the invention.
Figure 9:
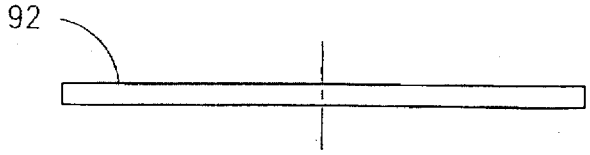
FIG. 9 is a side view of a support disc according to the invention.

The support disc 92 is best seen in FIG. 10, and includes an outer annulus 96 that extends beyond the opening in the piston guide 26 and preferably beyond a conical annular depression 98 (FIG. 8) centered on the opening. The cone angle of the conical annular depression 98 is about 1°–2°. The support disc 92 also includes an inner disc 100 that is smaller in diameter than the end 25 of the piston head 24. Between the outer annulus 96 and the inner disc 100 is a flexible segmented intermediate annulus 101 that preferably extends across and covers the conical depression 96, and is formed from several pie shaped segments 102. The flexible segmented intermediate annulus 101 is cantilevered between the outer annulus 96 and the inner disc 100 on inner torsion bars 104 and outer torsion bars 106.

The manner of construction of an exemplary outer torsion bar **106*a*, segment 102*a* and inner torsion bar 104*a* will now be described. The other torsion bars 104, 106 and segments 102 are formed in like manner. A single slot 107 is laser cut into the support disc 92 with an outer spiral portion 108*a*, inner spiral portion 112*a* and radial extending portion 110*a* interconnecting the inner and outer spiral portions. A similar slot 109 with outer spiral 108*b*, radial cut 110*b* and inner spiral 112*b* is laser cut into the support disc 92 angularly spaced from slot 107. The slots 107 and 109 define between them the outer torsion bar 106*a*, segment 102*a* and inner torsion bar 104*a*. Twelve segments 102 are shown, but a different number may be used. The torsion bars 104 of the inner set of torsion bars extend outward no further than the diameter of the piston head 24, such that some part of the segments 102 overlap onto and are supported by the piston head 24. The location of the torsion bars 106 of the outer set of torsion bars is not as critical as the degree of bending of the support disc 24 at the break in slope between the flat end face 99 and the conical depression 98 is not great. The torsion bars 106 should be located close to the break in slope to provide flexing of the support disc 24 over the break in slope while providing support for the support disc 24, and may overlie the break in slope or may extend no further outward than the outer boundary of the conical depression 98. The spiral slots 112 of the inner set of spiral slots terminate in inwardly curved portions 114 to assist in preventing crack propagation at the tips of the slots 112. The spiral slots 108 of the outer set of spiral slots also terminate in outwardly curved portions 116 to assist in preventing crack propagation at the tips of the slots 108**.

The inner turns 115 and outer turns 113 of the slots 109 in a 1½ inch disc may have a radius of about 0.030 inches. The outer slots 108 may cover two segments 102, thus covering 60°. The curved portions 114 and 116 may be curved over a 45° arc. In a 1½ inch (O.D.) disc, the outer torsion bars 106 may be at 0.537 inches from the center of the support disc 92, and the inner torsion bars 104 at 0.163 inches from the center. These dimensions have been found suitable, but others may be used depending on the material used and intended application.

The inner disc 100 may have a central aperture, but should be solid in the case where the piston 24 is bored through as for example as shown. The piston guide 26 may also be made of several pieces for ease of manufacturing. The pressure from the spring 42 should be sufficient to overcome the bending resistance of the support disc 92, such that in conditions of low pressure the support disc 92 may be forced to the extended position shown in FIG. 8. For pressure applications between 50 psi and 5000 psi, a disc made of Inconel™ steel preferably has a thickness of about 0.060 inches, while for pressure applications up to 2000 psi, a disc made of Inconel™ preferably has a thickness of about 0.025 inches. The support disc 92 may be bevelled at the edges, but preferably has straight edges as shown so that it may be reversibly fit against the diaphragm 30.

Figure 8:
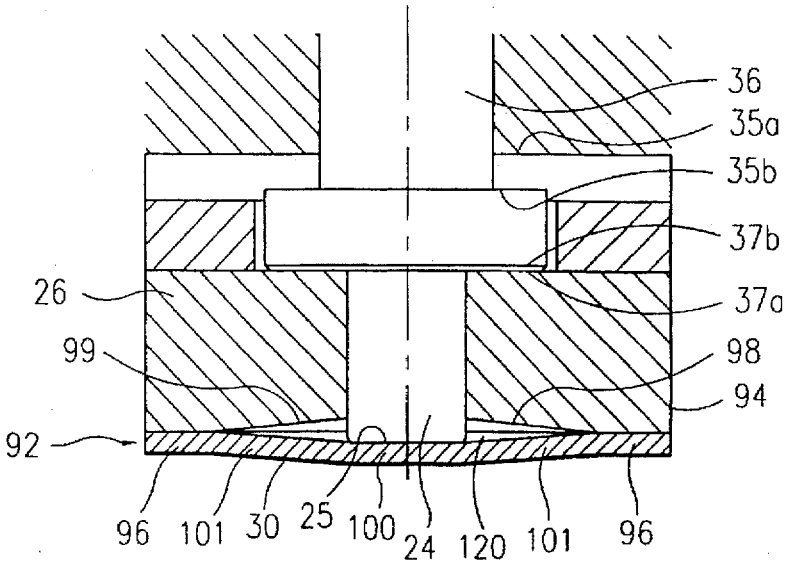
FIG. 8 is a cross-section through a piston, piston head, support disc and diaphragm combination according to the invention, with the diaphragm in the low pressure position.
Figure 11:
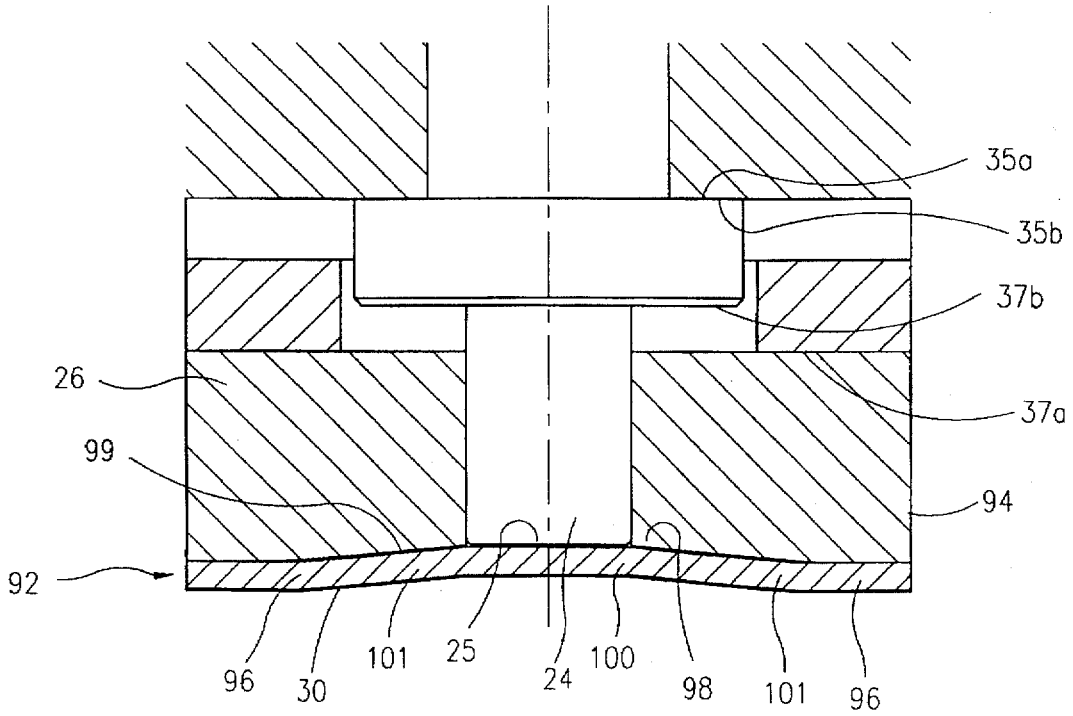
FIG. 11 is a cross-section through a piston, piston head, support disc and diaphragm combination according to the invention, with the diaphragm in the high pressure position.

The manner of operations of the support disc is as follows. As the diaphragm 30 moves under exterior pressure variations, such as may occur many times a second from a pump, it presses against the support disc 92 and travels from the maximum pressure position shown in FIG. 11 to the minimum pressure position shown in FIG. 8, a travel range of about 0.012 inches. In practice, pressure variations will be less than the maximum and greater than the minimum and the travel of the piston 24 will not be as great as shown, but FIGS. 8 and 11 illustrate the principle of operation. The support disc 24 is designed such that the entire diaphragm is supported by the support disc at all points of travel. At all except the maximum pressure position shown in FIG. 11, there is a space or gap 120 formed between the support disc 92 and the conical surface 98. The segments 102 span this gap as shown in FIG. 8 and support the diaphragm 30 over the gap 120. Pressure initially forces the support disc 92 flat against the flat end face 99 of the piston guide 26 and against the flat end of the piston head 24. At all except the middle position of travel of the piston head 24, this results in bending of the diaphragm and support disc 92. Since the support disc 92 must be strong enough to span the gap 120 and thus support the diaphragm, repeated bending of a solid support disc at the edge of the piston head 24 and at the outer periphery of the conical depression 98 would cause relatively early failure of the support disc through work hardening at the lines of bending, where all the bending is taken up in a relatively short distance (a few tens of thousandths of an inch for a 1½ inch disc). In the case of a support disc 92 with torsion bars 104, 106, the bending stresses are spread out over the length of the torsion bars, which in a 1½ inch diameter disc might be 0.2 inches for each torsion bar. The length of each torsion bar may extend the full length of one of the segments 102. Provision of inner and outer rings of torsion bars connected by segments delays failure due to work hardening but maintains the support function of the support disc. The size of the support disc 92 depends on the size of the pressure switch, and need not be limited by the exemplary dimensions set out here.

Figure 12:
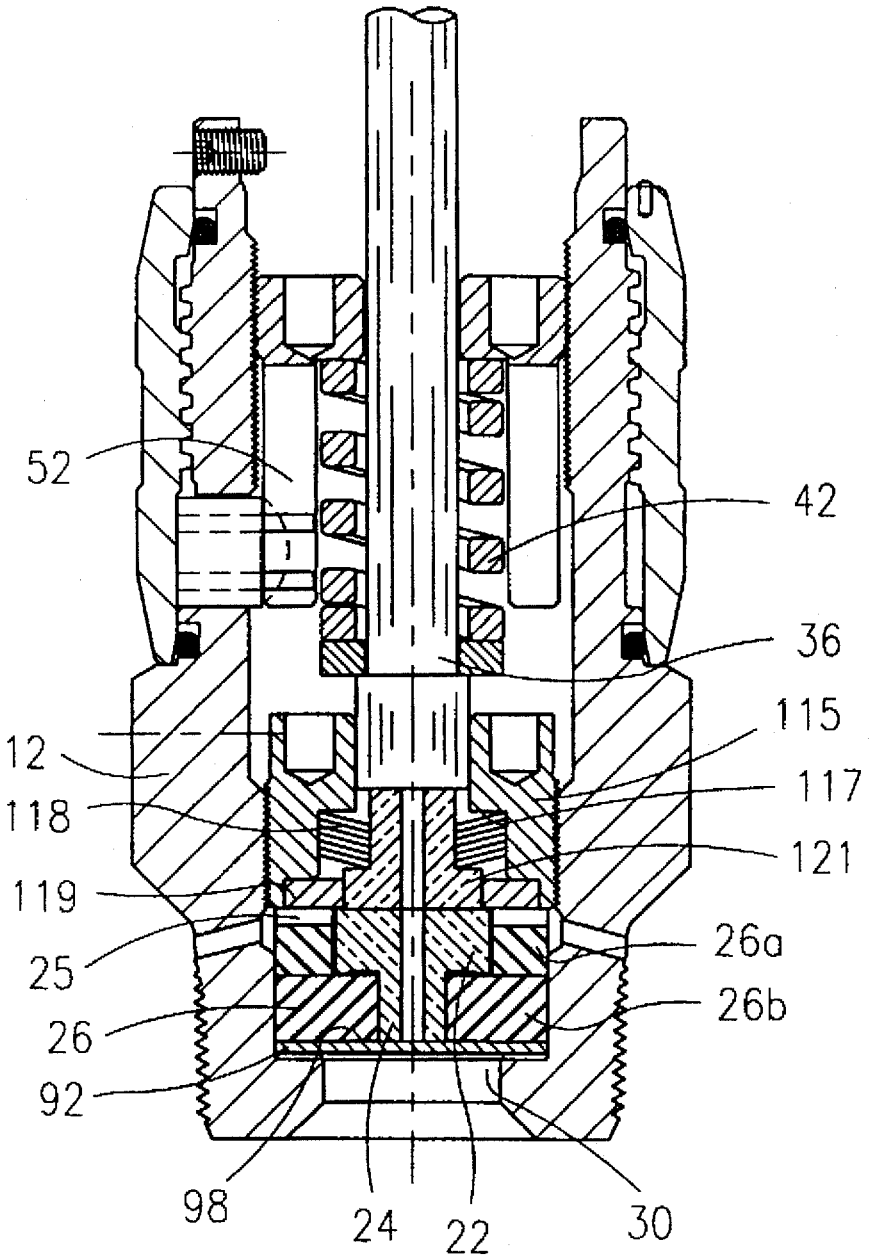
FIG. 12 is a longitudinal section through a second embodiment of the pressure switch according to the invention.

Referring to FIG. 12, a second embodiment of the switch is shown for use in high pressure applications. Nut 115, similar to nut 28 in FIG. 1, has been modified by extending it lengthwise to receive a belleville spring washer stack 118 held between a shoulder 117 and spacer 119. This belleville spring stack 118 helps assist spring 42 in providing resistance to movement of the piston 22 and rod 36 and therefore elevates the tripping pressure of the electrical switch 34. An intermediate stem 121 provides positive connection between the piston 22 and rod 36.

While the pressure switch has been shown with an exemplary and preferred electrical switch, other kinds of mechanically actuate switch, such as pneumatic or hydraulic, may be used.

A person skilled in the art could make immaterial modifications to the invention described and claimed in this patent without departing from the essence of the invention.

The embodiments of the invention in which an exclusive property or privilege is claimed are defined as follows:

1. A pressure switch comprising:

a housing;

a piston guide mounted within the housing, the piston guide having an interior bore and a first end, the interior bore forming an opening at the first end;

a diaphragm mounted on the piston guide across the opening;

a piston slidable over a limited range within the interior bore under external fluid pressure acting on the diaphragm, the piston having a piston head;

a mechanically operated switch operatively connected to the piston;

a support disc for the diaphragm, the support disc being mounted between the diaphragm and the piston; and the support disc being made of a high tensile elastic material and the support disc comprising an outer annulus that extends beyond the opening, an inner disc that is smaller in diameter than the piston head, and a flexible intermediate annulus cantilevered between the outer annulus and the inner disc.

2. The pressure switch of claim 1 in which the piston guide has a conical annular depression centered on the opening and the flexible intermediate annulus substantially covers the conical annular depression.

3. The pressure switch of claim 2 in which the limited range over which the piston is slidable is centered such that at maximum operating pressure the diaphragm flexes about the same amount as the diaphragm flexes at minimum pressure but in the opposite direction.

4. The pressure switch of claim 1 in which the flexible intermediate annulus is cantilevered on the inner disc and outer annulus by inner and outer sets of circumferentially extending torsion bars.

5. The pressure switch of claim 4 in which the piston head has a diameter and the torsion bars of the inner set of torsion bars extend outward no further than the diameter of the piston head.

6. The pressure switch of claim 4 in which the inner and outer sets of torsion bars are bounded and defined by inner and outer sets respectively of spiral slots.

7. The pressure switch of claim 6 in which the flexible intermediate annulus is divided into segments by radially extending slots joining corresponding spiral slots of the inner and outer sets of spiral slots.

8. The pressure switch of claim 7 in which spiral slots of the inner set of spiral slots terminate in inwardly curved portions.

9. The pressure switch of claim 7 in which spiral slots of the outer set of spiral slots terminate in outwardly curved portions.

10. The pressure switch of claim 4 in which torsion bars of the outer set of torsion bars are located at an outer boundary of a conical depression in the piston guide.

11. A pressure switch comprising:

a housing;

a piston guide mounted within the housing, the piston guide having an interior bore and a first end, the interior bore forming an opening at the first end;

a diaphragm mounted on the piston guide across the opening;

a piston slidable over a limited range within the interior bore under external fluid pressure acting on the diaphragm, the piston having a piston head;

a mechanically operated switch operatively connected to the piston;

a support disc for the diaphragm, the support disc being mounted between the diaphragm and the piston, the support disc being made of a high tensile elastic material and the support disc comprising:

an outer annulus that extends beyond the opening;

an inner disc that is smaller in diameter than the piston head; and a flexible segmented intermediate annulus cantilevered between the inner annulus and the outer disc on inner and outer sets respectively of circumferentially extending torsion bars.

12. The pressure switch of claim 11 in which the support disc is made of alloy steel.

13. The pressure switch of claim 11 in which the inner and outer sets of torsion bars are bounded and defined by inner and outer sets respectively of spiral slots.

14. The pressure switch of claim 13 in which segments of the segmented intermediate annulus are defined by radially extending slots joining corresponding spiral slots of the inner and outer sets of spiral slots.

15. The pressure switch of claim 13 in which spiral slots of the inner set of spiral slots terminate in inwardly curved portions.

16. The pressure switch of claim 13 in which spiral slots of the outer set of spiral slots terminate in outwardly curved portions.

* * * * *